United States Patent [19]

Graillat

[11] Patent Number: 4,915,406

[45] **Date of Patent: * Apr. 10, 1990**

[54] RAISED METALON

[75] Inventor: Gerard Graillat, Annecy, France

[73] Assignee: Salomon S. A., Annecy Cedex, France

[ * ] Notice: The portion of the term of this patent subsequent to Sep. 6, 2005 has been disclaimed.

[21] Appl. No.: 27,970

[22] Filed: Mar. 19, 1987

[30] Foreign Application Priority Data

Mar. 19, 1986 [FR] France ..... 86 03923

[51] Int. Cl.[4] ..... A63C 9/18

[52] U.S. Cl. ..... 280/615

[58] Field of Search ..... 280/615, 623, 625, 627, 280/635, 636, 614, 613, 618; 36/117

[56] References Cited

U.S. PATENT DOCUMENTS

| | | | |
|---|---|---|---|
| 3,606,368 | 9/1971 | Smolka et al. | 280/613 |
| 4,032,172 | 6/1977 | Pyzel et al. | 280/615 |
| 4,392,313 | 7/1983 | Linecker | 36/117 |
| 4,593,927 | 6/1986 | Salomon et al. | 280/618 |

FOREIGN PATENT DOCUMENTS

| | | | |
|---|---|---|---|
| 38540 | 2/1911 | Fed. Rep. of Germany | 280/618 |
| 2484799 | 12/1981 | France | 36/117 |
| 65020 | 7/1942 | Norway | 280/623 |

*Primary Examiner*—Charles A. Marmor
*Assistant Examiner*—Tamara L. Finlay
*Attorney, Agent, or Firm*—Pollock, Vande Sande & Priddy

[57] ABSTRACT

System comprising a cross country ski boot and a device to hold the front of the boot on a ski. The holding device (3) holds the front part (17*a*) of the sole (17) of the boot (1) flat on the upper part of the ski, in a holding zone extending between the front end of the sole and a rear limit (P, P1) thereof, located substantially under the metatarsal-phalangeal joint (A) of the skier's foot, and the boot (1) is shaped so that in the resting position the rear part (17*b*) of the sole is released obliquely from the upper part of the ski, i.e., the heel (17*c*) of the boot is normally raised.

16 Claims, 4 Drawing Sheets

RAISED METALON

FIELD OF THE INVENTION

This invention pertains to a system comprised of a cross country ski boot and a device to retain the front of this boot on a ski.

BACKGROUND OF THE INVENTION

In cross country skiing, it has been noted that the thrust force of the leg on the foot is more intense when the heel is in a raised relative position above the ski, a position in which the foot applies pressure especially on the area where the metatarsal and the phalanges meet, which is called the metatarsal-phalangeal joint.

PRIOR ART

To facilitate the raising of the heel, conventional devices for holding the front of a boot on a cross country ski are most often designed to allow the highest possible degree of freedom for the flexion of the boot, and, for this purpose, they comprise, on the one hand, means allowing the boot to pivot around its front end and, on the other hand, elastic means intended to facilitate the raising of the heel. For example, Austrian Patent No. 346,743 and Finnish Patent No. FI 55 936 pertain to devices of this type. Moreover, independently of holding devices, ski boots are known which are pre-deformed in the forward movement direction, in which the front part of the sole is inclined with respect to its rear part, forming an obtuse angle opening upward, with the heel located in elevated position, when the front part of the sole extends horizontally (German Patent No. 2,752,491). However, in the case of both the aforementioned holding devices and pre-deformed boots, the foot is pressed forward successively from the metatarsal-phalangeal joint to the end of the toes at the end of the pressing and, as such, the transmission of the force of the leg is retarded appreciably.

SUMMARY OF THE INVENTION

An object of this invention is to provide a boot-binding system comprising a holding device and a pre-deformed boot which, when combined, place the skier's foot on the ski in a position of active pressure repetition, a position in which the foot bears on the entire front surface of the plantar arch.

For this purpose, this system comprised of a cross country ski and a device for holding the front of the boot on a ski is characterized in that the holding device keeps the front part of the sole of the boot flat on the upper part of the ski in a holding zone extending between the front end of the sole and a rear limit thereof located substantially under the metatarsal-phalangeal joint area of the skier's foot, and the boot is shaped so that, at rest, i.e., when the skier's foot is not engaged in the boot held on the ski, or when the skier is not applying his foot in at least the vertical direction, the rear part of the sole, extending from the rear limit of the holding zone of the front part, is disengaged obliquely from the top of the ski, i.e., it is inclined upwards and to the rear so that the heel of the boot is normally raised a certain distance above the ski.

BRIEF DESCRIPTION OF THE DRAWINGS

Various embodiments of this invention are described below as non-limitative examples, with reference to the attached drawings, in which.

DESCRIPTION OF THE PREFERRED EMBODIMENTS

Figure 1:
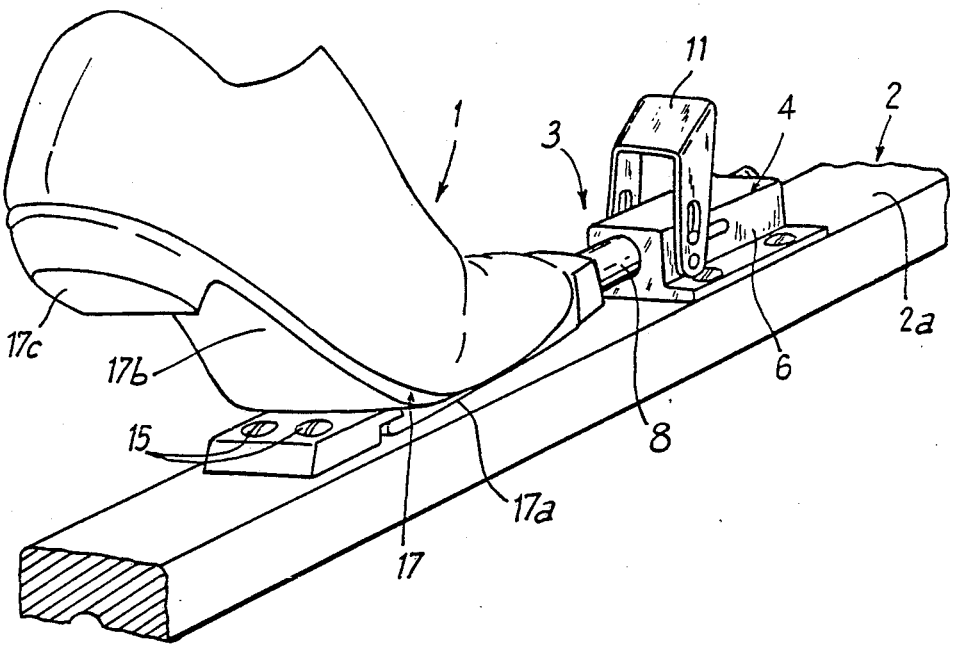
FIG. 1 is a perspective view of a boot-binding system with elastic locking according to the invention, and the boot is shown attached to the ski in resting position, i.e., without the engagement of the skier's foot in the boot.
Figure 2:
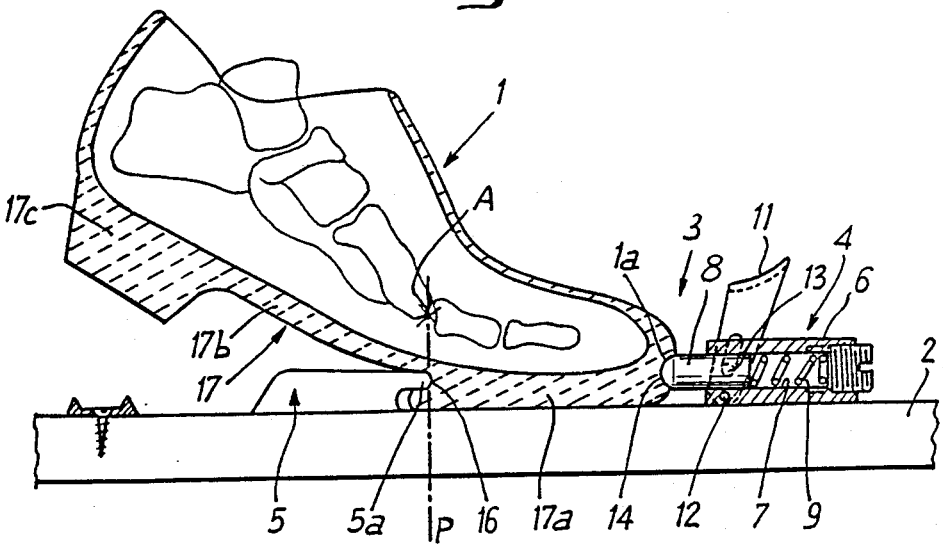
FIG. 2 is a vertical and longitudinal cross section of the boot-binding system in FIG. 1 in resting position.

The boot-binding system according to the invention which is shown in FIGS. 1 and 2 is intended to hold a cross country ski boot 1 on a ski 2 by means of a holding device 3.

In the embodiment illustrated in FIGS. 1 and 2, the holding device is of the elastic locking type and comprises two elements attached to the upper surface of the ski, namely, a front stop 4 and a rear fastening and holding block 5. The front stop 4 comprises a collet 6 having an internal longitudinal housing 7 in which a locking tappet 8 is slidably mounted, projecting towards the rear. This locking tappet 8 is biased towards the rear by a spring 9 placed in a longitudinal housing 7. The locking tapper 8 can be pushed forward using a lever 11 articulated on the collet 6 about a horizontal and transverse axis 12 and coupled to the locking tappet 8 through the intermediary of a transverse pin 13.

The locking tappet 8 engages in a corresponding depression 14 in the front end of the boot 1.

The rear fastening block 5 which is attached to the ski by screws 15 has, in its upper and front part, an edge **5*a* projecting forward, which engages in a corresponding groove 16 provided in the sole 17 of the boot 1. This sole 17 comprises a front holding part 17*a*, which is thicker than the rest of the sole comprises of a relatively thin intermediary part 17*b* located under the plantar arch and connected to the heel 17*c***.

It will be understood from the above description that the front part **17*a* of the sole 17 is immobilized flat on the upper part of the ski 2 between the front stop 4 and the rear fastening block 5. Moreover, the boot 1 is shaped so that at rest, i.e., when the skier's foot is not engaged in the boot, as shown in FIGS. 1 and 2, the rear part of the sole, comprising the relatively thin intermediary part 17*b* located under the plantar arch and the heel 17*c***, is disengaged obliquely from the upper part of the ski, i.e., it is inclined upward and towards the rear.

Consequently, at rest, the heel 17*c* of the boot 1 is normally raised a certain distance above the ski.

The relatively thick front part 17*a* of the sole 17 of the boot 1 extends over a distance in the longitudinal direction so that its rear limit defined by the vertical and transverse plane P passing substantially through the end of the edge 5*a* of the rear fastening block 5 or the bottom of the groove, is substantially located under the zone where the phalanges and the metatarsals of the skier's foot engaged in the boot meet, with the foot being shown in mixed lines in FIG. 2. In other words, the front holding part 17*a* of the sole 17 extends towards the rear up to a rear limit located under the metatarsal-phalangeal joint area indicated by A in FIG. 2, and this rear limit is constituted by plane P which is perpendicular to the longitudinal axis of the ski.

Because only the front part 17*a* of the sole 17 is held firmly, flat against the ski, all the rest of the sole and consequently the boot can bend freely, allowing the foot to be rolled back and forth during cross country skiing.

Figure 3:
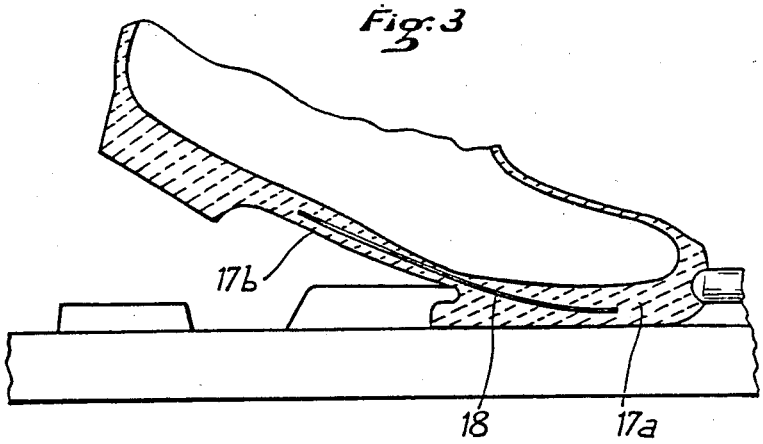
FIG. 3 is a vertical and longitudinal cross section of a second embodiment of the boot-binding system.

The ski boot 1 can be pre-formed using any appropriate means or process, for example, by molding the sole 17, and it can comprise any stiffening element and/or reinforcement element which can elastically withstand the flexion of the foot. FIG. 3 illustrates a stiffening element 18 in the shape of a blade which is embedded in the sole 17 in the front holding part 17*a* as well as in the intermediary part 17*b* located under the plantar arch.

Figure 4:
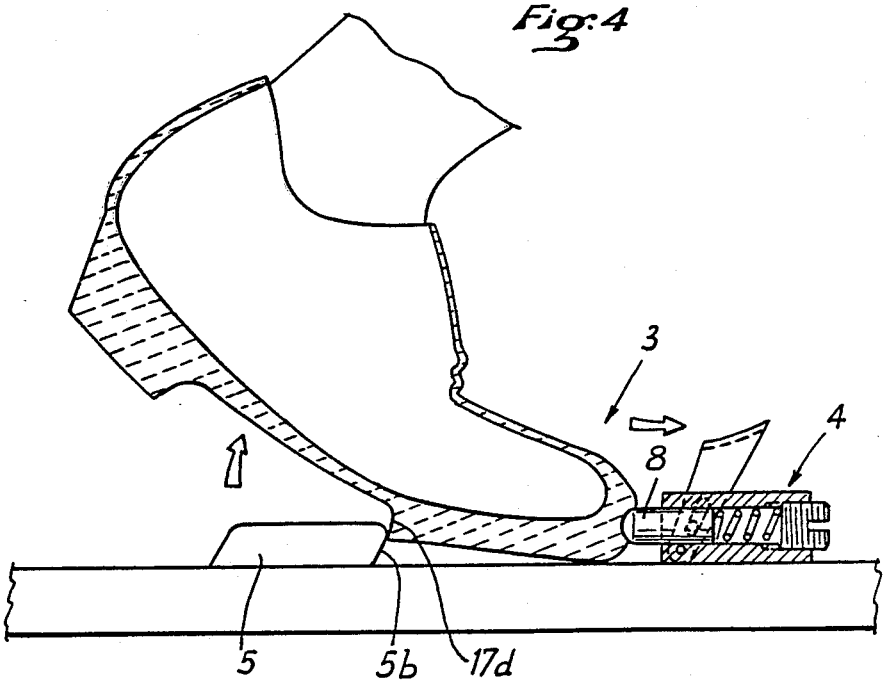
FIG. 4 is a vertical and longitudinal cross section of a third embodiment of a boot-binding system during the release of the boot when the skier falls forward.

FIG. 4 illustrates the manner in which the elastic locking front stop 4 makes it possible to release the boot in case the skier falls forward or in the case of dangerous stress applied to the boot substantially in the same direction. In this embodiment, the fastening block 5 has an anterior frontal surface 5*b* which is inclined from bottom to top and back to front and with this inclined surface 5*b* cooperates a posterior frontal surface 17*d* having the same slope and constituting the rear limit of the front holding part 17*a* of the sole 17. Consequently, when the skier falls forward, for example, the boot pivots in the clockwise direction around the end of the locking tappet 8, raising away from the rear fastening block 5, this raising being made possible by the relative sliding of the posterior frontal surface 17*d* of the sole on the anterior frontal surface 5*b* of the fastening block 5 against the effects of the thrust of the holding device 3. After the front part 17*a* of the sole is raised sufficiently, the latter can escape completely from the holding device 3 comprised of the front stop 4 and the rear fastening block 5.

Figure 6:
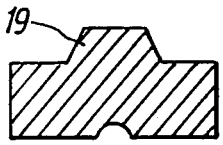
FIG. 6 is a vertical and transverse cross section along line VI—VI of FIG. 5.
Figure 5:
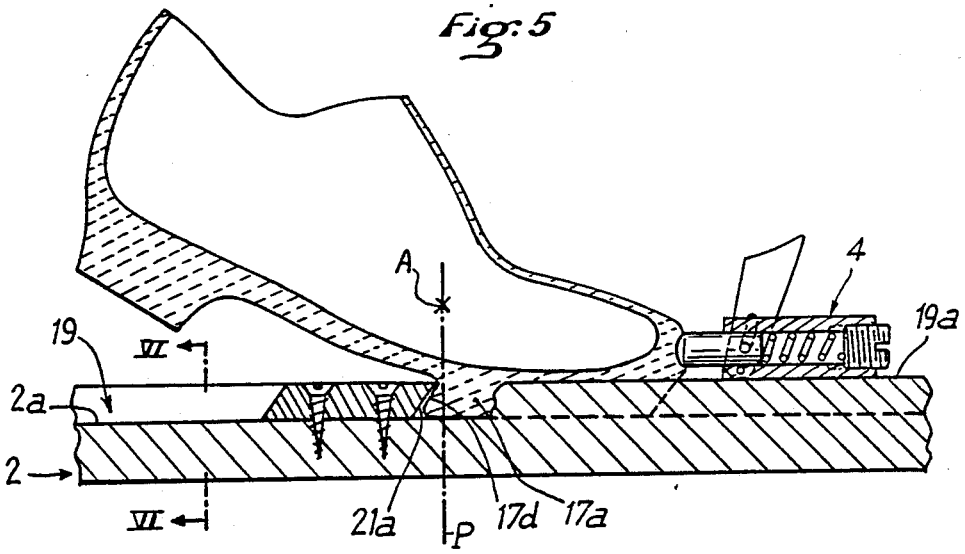
FIG. 5 is a vertical and longitudinal cross section of a fourth embodiment of a boot-binding system according to the invention adapted to a ski having a guiding and centering rib on its upper surface.
Figure 7:
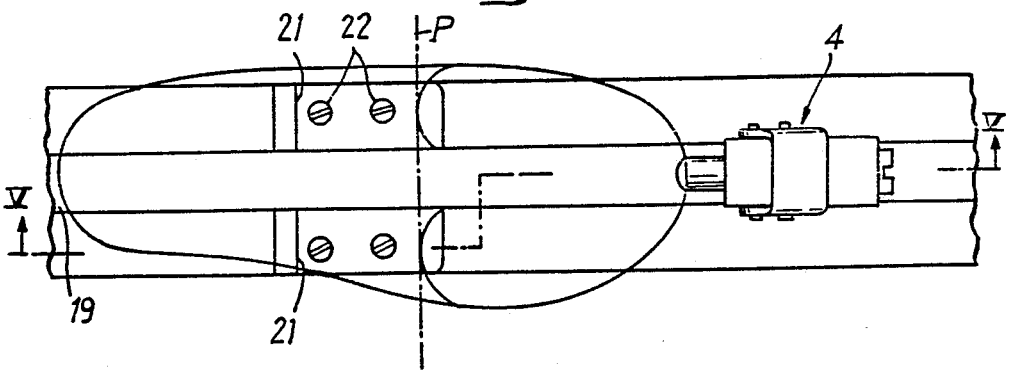
FIG. 7 is a schematic plan view of the boot-binding system in FIG. 5.

FIGS. 1 to 4 illustrate the application of the invention to a ski having a flat upper surface. FIGS. 5 to 7 illustrate an adaptation of the invention to a ski which has a longitudinal guiding and centering rib 19 on its upper surface 2*a* which can form a unit with the ski or can be comprised of an element mounted thereon. In this case, the front stop 4 ensuring the elastic locking can be mounted on an upper surface 19*a* of the rib 19, which preferably is of right trapezoidal section as shown in FIG. 6. To constitute the holding device 3, two rear fastening blocks 21 which are respectively attached to the upper surface 2*a* of the ski 2 on both sides of the central guide rib 19 cooperate with this front stop 4. These fastening blocks 21 can, in vertical cross section, have the shape of a parallelogram defining, for each one, a front transverse wall 21*a* inclined from bottom to top and back to front, for holding the front part 17*a* of the sole of the boot. In this embodiment, front part 17*a* has a longitudinal groove in its central part having substantially the same shape as the central guide rib 19 and fitting over the latter.

The two fastening blocks 21 are attached to the ski by screws 22 so that their front inclined transverse surfaces 21*a*, which are in contact with the rear limit surface 17*d* of the front part 17*a* of the sole 17, are located approximately under the metatarsal-phalangeal joint A of the skier's foot.

The upper horizontal surfaces of the two rear fastening blocks 21 can be flush with the upper horizontal surface 19*a* of the guide rib 19, as shown in FIG. 5, or they can be located at a higher or lower level.

Figure 8:
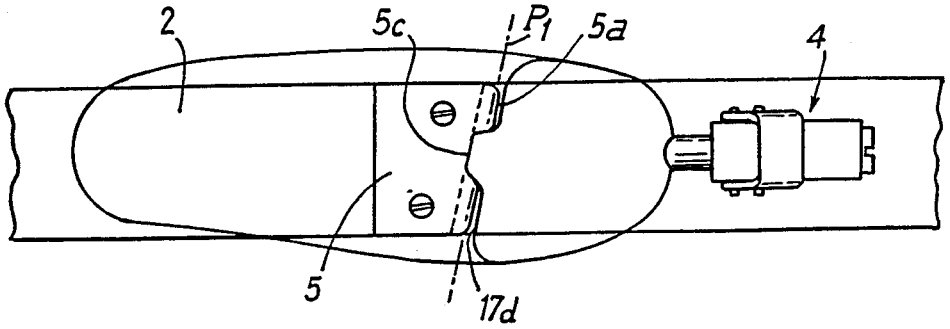
FIG. 8 is a plan view of a further embodiment.
Figure 9:
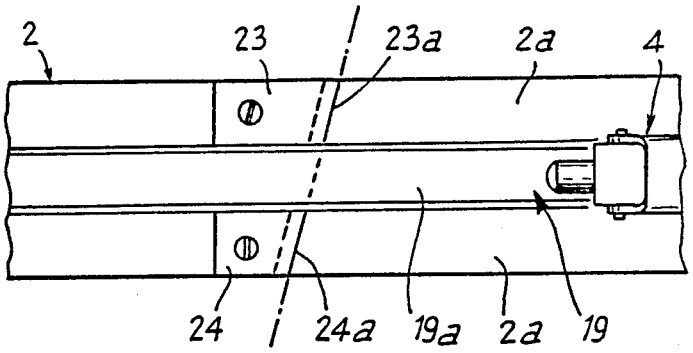
FIG. 9 is a plan view of a yet further embodiment.

In all the embodiments described above, the zone of flexion of the boot extends in a direction perpendicular to the longitudinal axis of the ski. FIGS. 8 and 9 shown different embodiments in which the flexion zone of the boot is inclined with respect to the longitudinal axis of the ski and substantially follows the natural axis for the flexion of the metatarsal-phalangeal joint A of the skier's foot. In FIG. 8, which corresponds to the case of a ski 2 having a flat upper surface, the fastening block 5 ends towards the front with an upper front edge 5*a* which extends following a plane P1 inclined with respect to the longitudinal axis of the ski and which, in plan view, is located substantially under the axis of the metatarsal-phalangeal joint A. In other words, the plane P1 containing the edge 5*a* is inclined from the rear to the front and the outside to the inside of the ski. The front edge 5*a* of the rear fastening block 5 can be continuous or can have a depression 5*c* in this central part, which is open towards the front and in which a boss provided in the frontal surface 17*d*, forming the rear limit of the front holding part 17*a* of the sole 17, engages.

In the embodiment shown in FIG. 9, the chosen device is adapted to a ski with a longitudinal guiding and centering rib 19 as illustrated in FIGS. 5 to 7. The two rear fastening blocks 23, 24, which are attached to the upper surface 2*a* of the ski on both sides of the guide rib 19, end in anterior frontal surfaces 23*a*, 24*a*, inclined from bottom to top and from back to front, with these two surfaces being coplanar and defining a zone of flexion for the boot inclined with respect to the longitudinal axis of the ski and substantially corresponding to the metatarsal-phalangeal joint A of the foot. Because of this incline of the zone of flexion, the anterior frontal surface 23*a* of the rear fastening block 23 located on the inner side of the ski is located slightly in front of the anterior frontal surface 24*a* of the rear anchoring block 24 located on the outer side of the ski.

Figure 10:
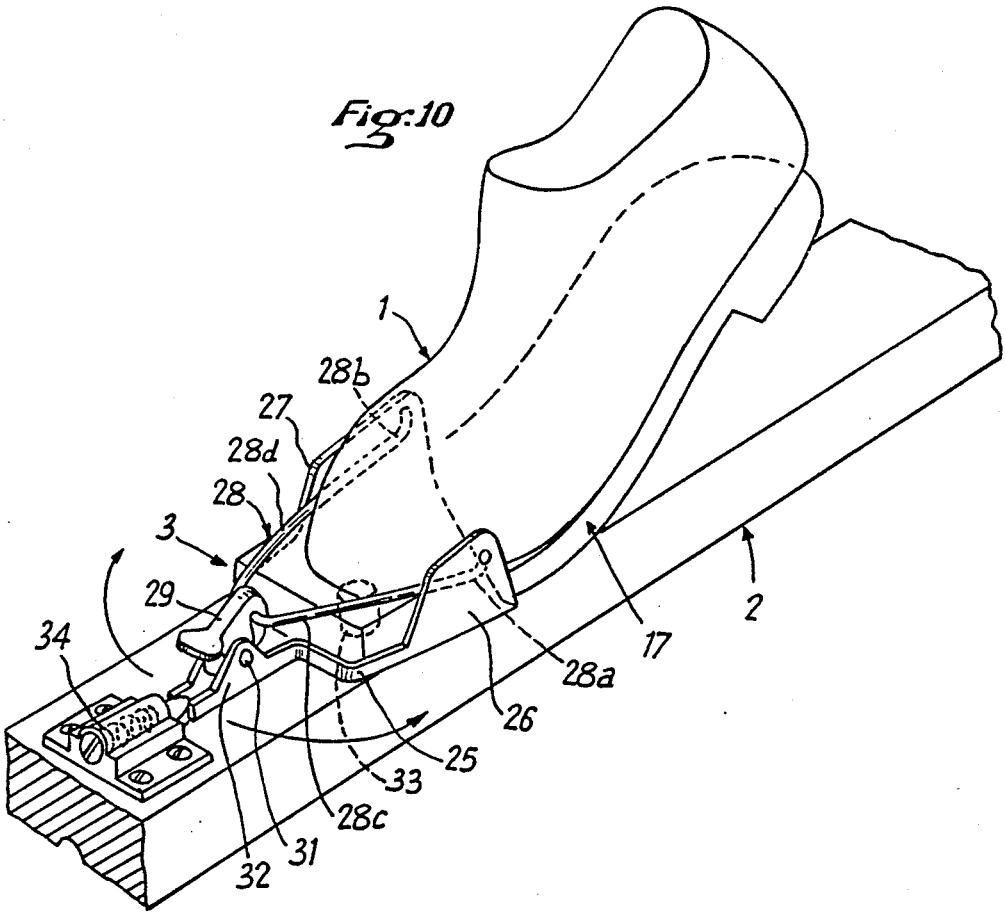
FIG. 10 is a perspective view of an embodiment in which the holding device is of the lateral release type.

In the embodiment of the invention shown in FIG. 10, the holding device 3 is of the laterial release type to allow the boot to be released in case the skier falls or dangerous torsion stress is applied at the level of the boot. This holding device comprises a plate 25 constituting a seating, which is mounted on the ski. In its rear part, this seating 25 has two vertical wings 26 and 27 which extend upward from the edges of the seating and which overhang the edges of the ski 2. The front part 17*a* of the sole 17 of the boot is held on the seating 25 of the holding device using a U-shaped spring 28 which is open towards the rear and whose ends 28*a*, 28*b*, cambered in an appropriate manner, are engaged in holes pierced respectively in the upper parts of the wings 26 and 27 in order to constitute pivoting axes for the spring 28. Wing 26 is the inside wing, i.e., that which faces the other ski (not shown), while the other wing 27 is located on the outside of the ski. The highest point of the spring 28, i.e., its central front part, crosses a locking lever 29 mounted in a pivoting manner around a horizontal and transverse axis 31, on a cap 32 extending the seating 25 forward.

When the boot 1 is held on the ski 2, the two branches 28*c* and 28*d* of the spring 28 which extend towards the rear are held pressed on the upper surface of the sole 17, on both sides of the upper of the boot 1. Moreover, the wings 26, 27 and the branches 28*c*, 28*d* extend to the rear substantially up to plane P1 defined above, which contains the metatarsal-phalangeal joint.

The seating 25 of the holding device 3 is mounted in a rotating manner on the ski 2, about an axis 33 perpendicular to the ski, and the front part of the seating 25 is held in locked position using an elastic locking device 34 of any known type, fastened to the ski. This device thus allows the lateral release of the binding in case of torsion exerted on the leg, as shown schematically by the arrows in FIG. 10.

The invention is not limited to the embodiments described above. The holding zone for the front part 17*a* of the sole 17 up to a rear limit, the maximum of which can be located at the level of the metatarsal-phalangeal joint area A of the skier's foot as described above but also at a distance smaller than that between A and the front end of the sole.

What is claimed is:

1. System comprised of a cross country ski boot and a holding device for fastening said boot on a ski, said holding device (3) retaining a front portion (17*a*) of a sole (17) on an underside of said boot (1) flat on an upper surface of said ski, in a holding zone between a front end of said sole and a rear limit (P, P1) thereof, said boot (1) being so shaped that, at rest, when a foot of a skier is not engaged in said boot held on said ski (2) or when said skier is not applying his foot at least in a vertical direction, a rear portion (17*b*) of said sole extending from said rear limit of said holding zone of said front portion (17*a*) is engaged obliquely to said upper surface of said ski, i.e., it is inclined upwards and towards the rear so that a heel (17*c*) of said boot is normally raised a certain distance above said ski (2).

2. System according to claim 1, wherein said holding zone extending from said front end of said sole to said rear limit thereof is located substantially under a metatarsal-phalangeal joint area (A) of said foot.

3. System according to claim 2, wherein said rear limit (P1) of said front portion (17*a*) of said sole (17) extends obliquely with respect to a longitudinal axis of said ski, said rear limit (P1) being inclined from rear to front from an outside face to an inside face of said ski.

4. System according to claim 1, wherein said rear limit (P) of said front portion (17*a*) of said sole (17) extends vertically perpendicularly to a longitudinal axis of said ski.

5. System according to claim 1, wherein said holding device (3) is of an elastic locking type and comprises two elements attached to said upper surface of said ski, namely, a front stop (4) and at least one rear fastening and holding block (5) cooperating with said rear limit (P, P1) of said holding zone of said sole (17).

6. System according to claim 5, wherein said front stop (4) comprises a collet (6) having an internal longitudinal housing (7) in which a locking tappet (8) is slidably mounted, projecting towards the rear, said locking tappet (8) being biased rearwardly by spring means (9) located in said housing (7), being pushed forward by means of a lever (11) articulated on said collet (6) about a horizontal and transverse axis (12) and said tappet engaging in a corresponding depression (14) provided in a front end (1*a*) of said boot.

7. System according to claim 5 or 6, wherein said rear fastening and holding block (5) has, in its upper and front part, a forwardly projecting transverse edge (5*a*) which engages in a corresponding transverse groove (16) in said sole (17) of said boot (1), said edge (5*a*) being perpendicular to said longitudinal axis of said ski.

8. System according to claim 5 or 6, wherein said rear fastening and holding block (5) has, in its upper and front part, a forwardly projecting edge (5*a*) which engages in a corresponding groove (16) in said sole (17) of said boot, said edge (5*a*) being inclined from rear to front from an outside face to an inside face of said ski.

9. System according to claim 5 or 6, wherein said fastening block (5) has an anterior frontal surface (5*b*) perpendicular to said longitudinal axis of said ski, said surface being inclined from bottom to top and back to front, a frontal surface cooperating with said inclined surface (5*b*), said frontal surface having the same slope (17*d*), which constitutes said rear limit of said front holding part (17*a*) of said sole (17).

10. System according to claim 5 or 6, wherein said fastening block (5) has an anterior frontal surface (5*b*) inclined from back to front and outside to inside with respect to the latter, said surface being inclined from bottom to top and back to front, a frontal surface cooperating with said inclined surface (5*b*), said frontal surface having the same slope (17*d*), which constitutes said rear limit of said front holding part (17*a*) of said sole (17).

11. System according to claim 1, applied to a ski having on its upper surface (2*a*) a longitudinal guiding and centering rib (19) comprising an element mounted thereon, said front stop (4) ensuring elastic locking being mounted on an upper surface (19*a*) of said rib (19), said front stop (4) cooperating with two rear fastening blocks (21; 23, 24) respectively attached to said upper surface (2*a*) of said ski (2) on both sides of said central guiding rib (19), so as to constitute said holding device (3).

12. System according to claim 1, wherein a stiffening element (18) is embedded in the sole (17) both in said front portion (17*a*) and said rear portion (17*b*) located under a plantar arch of said foot.

13. System according to claim 1, applied to a ski having on its upper surface (2*a*) a longitudinal guiding and centering rib (19) forming a unit with the ski, said front stop (4) ensuring elastic locking being mounted on an upper surface (19*a*) of said rib (19), said front stop (4) cooperating with two rear fastening blocks (21; 23, 24) respectively attached to said surface (2*a*) of said ski (2) on both sides of said central guiding rib (19), so as to constitute said holding device (3).

14. System according to claim 13, wherein each fastening block (21) in vertical cross section has the shape of a parallelogram, defining for each said fastening block a front transverse wall (21*a*) inclined from bottom to top and rear to front, to hold said front part (17*a*) of said sole of said boot which, in its center part, has a longitudinal rib having substantially the same shape as said central guiding rib (19) and fitting over said central guiding rib, said two fastening blocks (21) being attached to said ski so that their inclined front transverse surfaces (21*a*) which are in contact with said rear limit surface (17*d*) of said front part (17*a*) of said sole (17) are located approximately under the metatarsal-phalangeal joint (A) of the skier's foot.

15. System according to claim 14, wherein said anterior frontal surfaces (23*a*, 24*a*) inclined from bottom to top and back to front of the two rear fastening blocks (23, 24) are coplanar and define a zone of flexion for said boot inclined with respect to said longitudinal axis of said ski and correspond substantially to the metatarsal-phalangeal joint (A) of the skier's foot, and, due to this incline of the zone of flexion, said anterior front surface (23*a*) of said rear fastening block (23) located on the inner side of said ski is situated slightly in front of the anterior frontal surface (24*a*) of said rear fastening block (24) located on the outer side of said ski.

16. System according to claim 1, wherein said holding device has a plate (25) constituting a seating which in its rear part has two vertical wings (26 and 27) which extend upward from the edges of said seating (4) and means (28) to hold said front part (17*a*) of said sole (17) of said boot on said seating (25) of said holding device (3), said seating (25) being mounted on said ski (2) for rotation about an axis (33) perpendicular to said ski, and said front part of said seating (25) being held in locked position by an elastic locking device (34).

* * * * *